US008425621B2

(12) United States Patent
Falkowski et al.

(10) Patent No.: US 8,425,621 B2
(45) Date of Patent: Apr. 23, 2013

(54) TEXTILE FINISHING

(75) Inventors: Jürgen Falkowski, Monheim (DE); Werner Mauer, Alberstoh (DE); Raymond Mathis, Düsseldorf (DE); Karsten Matz, Essen (DE)

(73) Assignee: Cognis IP Management GmbH, Duesseldorf (DE)

( * ) Notice: Subject to any disclaimer, the term of this patent is extended or adjusted under 35 U.S.C. 154(b) by 599 days.

(21) Appl. No.: 12/090,300

(22) PCT Filed: Oct. 6, 2006

(86) PCT No.: PCT/EP2006/009676

§ 371 (c)(1),
(2), (4) Date: Apr. 15, 2008

(87) PCT Pub. No.: WO2007/045363

PCT Pub. Date: Apr. 26, 2007

(65) Prior Publication Data

US 2008/0276383 A1 Nov. 13, 2008

(30) Foreign Application Priority Data

Oct. 15, 2005 (DE) ..... 10 2005 049 429

(51) Int. Cl.
*D06M 23/02* (2006.01)
*D06M 13/184* (2006.01)

(52) U.S. Cl.
USPC ..... 8/115.6; 8/115.51; 252/8.61

(58) Field of Classification Search ..... 8/115.6, 8/115.51; 252/8.61, 8.81
See application file for complete search history.

(56) References Cited

U.S. PATENT DOCUMENTS

| | | | | |
|---|---|---|---|---|
| 2,664,409 | A * | 12/1953 | Munden et al. | 524/310 |
| 3,081,190 | A * | 3/1963 | Johnson | 8/116.1 |
| 6,417,152 | B1 * | 7/2002 | Kottwitz et al. | 510/392 |
| 2001/0031714 | A1 * | 10/2001 | Gassenmeier et al. | 510/276 |
| 2005/0152953 | A1 | 7/2005 | Wild et al. | |
| 2005/0153865 | A1 * | 7/2005 | Detering et al. | 510/475 |

FOREIGN PATENT DOCUMENTS

| | | | |
|---|---|---|---|
| GB | 1 222 152 | A | 2/1971 |
| WO | WO 03/068232 | A1 | 8/2003 |

OTHER PUBLICATIONS

Schulman et al. Mechanism of Formation and Structure or Micro Emulsions by Electron Microscopy, Oct. 1959, pp. 1677-1680.*

* cited by examiner

*Primary Examiner* — Lorna M Douyon
*Assistant Examiner* — Amina Khan
(74) *Attorney, Agent, or Firm* — Servilla Whitney LLC

(57) ABSTRACT

A process for finishing textiles with oil components is provided, and includes preparing an aqueous oil-in-water emulsion of one or more oil components using one or more alkali metal and/or alkaline earth metal soaps of one or more $C_{6-24}$ fatty acids as emulsifiers; introducing a textile into the aqueous oil-in-water emulsion; and reducing the pH of the aqueous oil-in-water emulsion by adding an acid.

18 Claims, No Drawings

TEXTILE FINISHING

CROSS-REFERENCE TO RELATED APPLICATIONS

This application is a national phase filing under 35 U.S.C. §371 and claims priority to International Application No. PCT/EP2006/009676 which has an International filing date of Oct. 6, 2006, and which designated the United States of America and which claims priority to German Application No. 10 2005 049 429.3, filed Oct. 15, 2005, the entire disclosures of which are hereby incorporated herein by reference.

BACKGROUND OF THE INVENTION

1. Field of the Invention

This invention relates generally to a process for finishing textiles with oil components, and more particularly, to a process for finishing textiles with one or more oil components using one or more alkali metal and/or alkaline earth metal soaps of one or more $C_{6-24}$ fatty acids as emulsifiers.

2. Background Information

High-quality textiles are being increasingly produced using oil mixtures which impart skin-care properties to the textiles. These oil mixtures are capable of imparting moisturizing, smoothing or lipid-layer-enhancing properties to the skin when taken up through the textile fabric. For finishing textiles with oil mixtures, the oil mixtures are normally used in the form of an aqueous dispersion which is further diluted in the textile liquor. These aqueous solutions may the be used, for example, in a padding or absorption process for finishing textiles. Absorption processes are preferably used in textile-processing factories, above all for the finishing of textile fabrics or made-up textiles produced completely or partly from modern synthetic fibers, such as, for example, polyester, polyamide or elastane. In the exhaust method for applying oil mixtures, it is important to bear in mind that the oil not absorbed by the textile is lost which can make finishing uneconomical in view of high production costs and expensive ingredients. In addition, there is the danger that too little of the oil mixture is absorbed by the textile, so that the desired skin-care effect is not achieved. In addition, the oil mixture can be unevenly absorbed so that unsightly stains are left behind on the textiles. In the finishing of textile with oil mixtures, product losses occur in particular in the absorption process because the oils used are not completely absorbed by the fibers.

SUMMARY OF THE INVENTION

Briefly described, according to an aspect of the invention, a process for finishing textiles with oil components includes preparing an aqueous oil-in-water emulsion of one or more oil components using one or more alkali metal and/or alkaline earth metal soaps of one or more $C_{6-24}$ fatty acids as emulsifiers; introducing a textile into the aqueous oil-in-water emulsion; and reducing the pH of the aqueous oil-in-water emulsion by adding an acid.

DETAILED DESCRIPTION OF THE INVENTION

The problem addressed by the present invention was to develop a process which would enable oil mixtures to be applied to textiles by the exhaust method without significant losses and staining.

It has now surprisingly been found that this problem is excellently solved in every respect by preparing an o/w emulsion containing alkali metal and/or alkaline earth metal soaps of fatty acids as emulsifiers for oil components, contacting this emulsion with the textile to be finished and then changing to the acidic pH range by addition of acid, the emulsifying alkali metal and/or alkaline earth metal soaps being converted into the corresponding fatty acids and the previously emulsified oil being released. Very good absorption rates of oil components onto the textile are achieved in this way.

The present invention relates to a process for finishing textiles with oil components, characterized in that (1) an aqueous emulsion of oil components is prepared using alkali metal and/or alkaline earth metal soaps of $C_{6-24}$ fatty acids as emulsifiers, the fatty acid soaps either being used as such or being produced in situ from fatty acids and alkali metal hydroxides, (2) textile is introduced into the o/w emulsion thus prepared, if desired with further dilution with water, and (3) the pH of the aqueous liquor is slowly reduced by addition of organic and/or inorganic acids, so that the alkali metal and/or alkaline earth metal soaps present in the liquor are converted into the corresponding fatty acids.

The major advantages of the described invention are:

- preparation of o/w emulsion in step (1) using inexpensive, readily available and ecologically advantageous fatty acid soaps,
- simple process management by control of the absorption rate through the pH value in step (3),
- very high oil absorption rates on the textiles to be finished because the soaps used as emulsifiers are split into non-emulsifying fatty acid after reduction of the pH,
- if microcapsules containing additional skin-care raw materials are added to the liquor as a further component in step (2), which is optionally possible, there is no interaction between the soaps used as emulsifiers and the anionic microcapsules.

In one embodiment, the alkali metal and/or alkaline earth metal soaps of the $C_{6-24}$ fatty acids used in step (1) are selected so that they have an HLB value of 8 to 25.

In a preferred embodiment, the alkali metal and/or alkaline earth metal soaps of the $C_{6-24}$ fatty acids used in step (1) are prepared in situ by mixing the required oils with one or more $C_{6-24}$ fatty acids, adding water and converting the fatty acids into the corresponding soaps by addition of alkali metal and/or alkaline earth metal hydroxides.

In another embodiment, the o/w emulsion prepared in step (1) contains 1 to 90% by weight—based on the emulsion as a whole—of oil components. The o/w emulsion prepared in step (1) preferably contains 10 to 70% by weight and more particularly 30 to 60% by weight—based on the emulsion as a whole—of oil components.

Basically, the invention is not limited in any way in regard to the oil components. The oils used are preferably oils with a care effect for human skin. Individual oils or mixtures of various oils may be used. In the interests of clarity, it is pointed out that the term "oils" is known to the expert and comprises three main groups, namely mineral oils, vegetable and animal oils and essential oils.

In an optional embodiment, the oils used as the oil component additionally contain oil-soluble components. Basically, there are no particular limitations as to the nature of these components. Examples of particularly suitable components of this type are oil-soluble plant extracts, vitamins and provitamins, perfumes and perfume oils, repellants, insecticides and the like.

Examples of vitamins and provitamins are vitamin A, vitamin C, vitamin E (α-tocopherol), vitamin F (polyene fatty acids), panthenol (provitamin B5), β-carotene (provitamin A) and derivatives thereof (for example esters, such as stearyl ascorbate). Suitable tocopherols are, for example, the natural tocopherols and mixtures thereof and synthetic tocopherols. Suitable derivatives are, for example, tocopheryl acetate, tocopherol nicotinate, tocopheryl ascorbate, tocopheryl retinoate, tocopheryl succinate, tocopheryl linoleate or tocopheryl benzoate.

Individual perfume compounds may be used as perfume oils or perfumes and include, for example, synthetic products of the ester, ether, aldehyde, ketone, alcohol and hydrocarbon type. Examples of perfume compounds of the ester type are benzyl acetate, phenoxyethyl isobutyrate, p-tert.butyl cyclohexylacetate, linalyl acetate, dimethyl benzyl carbinyl acetate, phenyl ethyl acetate, linalyl benzoate, benzyl formate, ethylmethyl phenyl glycinate, allyl cyclohexyl propionate, styrallyl propionate and benzyl salicylate. Ethers include, for example, benzyl ethyl ether while aldehydes include, for example, the linear alkanals containing 8 to 18 carbon atoms, citral (geranial), citronellal, citronellyloxyaoetaldehyde, cyclamen aldehyde, hydroxycitronellal, lilial and bourgeonal. Examples of suitable ketones are the ionones, α-isomethylionone and methyl cedryl ketone. Suitable alcohols are anethol, citronellol, eugenol, isoeugenol, geraniol, linalool, phenylethyl alcohol and terpineol. The hydrocarbons mainly include the terpenes, such as limonene and α-pinene. Eucalyptol (1,8-cineol) may also be used as a perfume. However, it is preferred to use mixtures of different perfume compounds which, together, produce an agreeable fragrance. Such perfume oils may also contain natural perfume mixtures which are obtainable from vegetable sources, for example pine, citrus, jasmine, patchouli, rose or ylang-ylang oil. Other suitable perfume oils are sage oil, camomile oil, clove oil, melissa oil, mint oil, eucalyptus oil, cinnamon leaf oil, lime-blossom oil, juniper berry oil, vetiver oil, olibanum oil, galbanum oil and ladanum oil and orange blossom oil, neroli oil, orange peel oil and sandalwood oil. Other suitable perfumes are nitriles, sulfides, oximes, acetals, ketals, acids, Schiff's bases, heterocyclic nitrogen compounds, such as indole and quinoline, pyrazines, amines, such as anthanilates, amides, organohalogen compounds, such as rose acetate, nitrated compounds, such as nitromusk, heterocyclic sulfur compounds, such as thiazoles, and heterocyclic oxygen compounds, such as epoxides, which are all known to the expert as possible perfumes.

In another optional embodiment, microcapsules may, if desired, be added to the oils to be used in accordance with the invention. In this case, it is advisable to provide either the microcapsules or the fibers with a cationic finish so that the capsules are better attached to the textile fibers.

Basically, the liquor ratios used in step (2) are not critical. In a preferred embodiment, liquor ratios of 1:10 to 1:15 are adjusted in step (2). The term "liquor ratio" is known to the expert and applies to the ratio between the quantity of textile and the volume of water in the machine used for finishing.

Basically, there are no particular limitations as to the nature of the acids to be used in step 3, providing it is ensured that these acids are capable of converting the alkali metal and/or alkaline earth metal soaps of the above-mentioned fatty acids used as emulsifiers into the free fatty acids. In a preferred embodiment, the acid used in step (3) is selected from the group consisting of acetic acid, lactic acid and glycolic acid.

The pH reduction in step (3) is preferably gradual. This ensures that the oil components are absorbed by the textile in very large quantities. The pH reduction in step (3) preferably takes place at such a rate that the textile absorbs the oil components in quantities of at least 70% and, more particularly, at least 80%, based on the total quantity of oils present in the liquor.

If desired, the liquor remaining behind after step (3) may be reused. To this end, oils and alkali metal and/or alkaline earth metal hydroxides are added to the residual liquor, thus starting a new finishing cycle in step (1).

EXAMPLES

I. Production of 1 kg of an Oil Emulsion Capable of Absorption by Textiles

Example 1

500 grams of a skin-care oil mixture prepared beforehand by stirring together 350 grams of passion flower oil (CEGESOFT® PFO, a product of Cognis), 100 grams of squalane (Fitoderm, a product of Cognis) and 50 grams of vitamin E acetate (DL-α-tocopheryl acetate, a product of BASF) were introduced into a stirred reactor and heated to 50° C. 30 grams of oleic acid (EDENOR® PK 1805, a Cognis product) and 400 grams of deionized water were then added. 60 grams of a 10% potassium hydroxide solution (Merck) were then added with stirring at 50° C. The emulsion formed was preserved by the addition after cooling of 10 grams of PHENONIP® (Clariant).

II. Application to Textiles

Example 2

10 commercially-available knee-length socks (material: polyamide containing 2% elastane, manufacturer: Falke) with a total weight of 120 grams were stirred into, and heated to 40° C. in, a water-based liquor consisting of a mixture of 24 grams of the 50% emulsion produced in the Example and 1800 grams deionized water. The measured pH value was 8.6. 70 grams of a 10% acetic acid solution were then slowly added with stirring, followed by stirring for 30 minutes at 40° C. The socks were then rinsed with deionized water, dried for 3 hours at 80° C. in a drying cupboard and weighed. The total weight of the dry socks was 130 grams, corresponding to a weight increase of 8.3%. Accordingly, of the total of 12 grams of oils present in 24 grams of emulsion, 10 grams or about 83% were absorbed by the textile. After drying, the socks had a pleasant, dry feel.

What is claimed is:

1. A process for finishing textiles with oil components, comprising:

preparing an oil-in-water emulsion of one or more oil components using one or more alkali metal and/or alkaline earth metal soaps of one or more $C_{6-24}$ fatty acids as emulsifiers;

introducing a textile into the oil-in-water emulsion; and reducing the pH of the aqueous oil-in-water emulsion by adding an acid;

whereby the reduction of the pH of the aqueous oil-in-water emulsion is sufficient to convert the alkali metal and/or alkaline earth metal soaps into free fatty acids;

whereby the oil components are released from the emulsion and absorbed onto the textiles, wherein the step of reducing the pH occurs gradually so that the textile absorbs the one or more oil components in quantities of at least 70%, based on the total quantity of the one or more oil components present in the aqueous oil-in-water emulsion.

2. The process according to claim 1, wherein the one or more alkali metal and/or alkaline earth metal soaps of the one or more $C_{6-24}$ fatty acids are produced in situ from one or more C6-24 fatty acids and one or more alkali metal hydroxides.

3. The process according to claim 1, wherein the step of introducing a textile into the aqueous oil-in-water emulsion further comprises diluting the emulsion with water to form an aqueous liquor.

4. The process according to claim 1, wherein the pH is reduced with an organic acid.

5. The process according to claim 1, wherein the pH is reduced with an inorganic acid.

6. The process according to claim 1, wherein the one or more alkali metal and/or alkaline earth metal soaps of the one or more $C_{6-24}$ fatty acids have a hydrophilic-lipophilic balance of 8 to 25.

7. The process according to claim 1, wherein the oil-in-water emulsion contains 1 to 90% by weight, of the one or more oil components, based on the weight of the aqueous oil-in-water emulsion.

8. The process according to claim 1, wherein the oil-in-water emulsion contains 10 to 70% by weight of one or more oil components, based on the weight of the aqueous oil-in-water emulsion.

9. The process according to claim 1, wherein the oil-in-water emulsion contains 30 to 60% by weight of one or more oil components, based on the weight of the aqueous oil-in-water emulsion.

10. The process according to claim 3, wherein the textile to aqueous liquor ratios of 1:10 to 1:15 are adjusted.

11. The process according to claim 1, wherein the acid is selected from the group consisting of acetic acid, lactic acid and glycolic acid.

12. The process according to claim 3, wherein the step of reducing the pH occurs gradually so that the textile absorbs the one or more oil components in quantities of at least 70%, based on the total quantity of the one or more oil components present in the aqueous liquor.

13. The process according to claim 1, wherein the one or more alkali metal and/or alkaline earth metal soaps of the one or more $C_{6-24}$ fatty acids are prepared in situ by mixing the one or more oil components with the one or more $C_{6-24}$ fatty acids, adding water, and converting the one or more $C_{6-24}$ fatty acids into the corresponding soaps by the addition of one or more alkali metal and/or alkaline earth metal hydroxides.

14. The process according to claim 1, wherein the one or more oil components additionally contain one or more oil-soluble components.

15. The process according to claim 14, wherein the one or more oil-soluble components are selected from the group consisting of oil-soluble plant extracts, vitamins, provitamins, perfumes, perfume oils, and mixtures thereof.

16. The process according to claim 1, further comprising the step of adding one or more oil components and one or more alkali metal and/or alkaline earth metal hydroxides to the residual liquor remaining after the step of reducing the pH, wherein the resulting product is the oil-in-water emulsion, and the steps of introducing a textile into the aqueous oil-in-water emulsion and reducing the pH of the aqueous oil-in-water emulsion by adding an acid are repeated.

17. The process according to claim 1, wherein the step of reducing the pH of the aqueous oil-in-water emulsion by adding an acid occurs after the step of introducing a textile into the oil-in-water emulsion.

18. The process according to claim 1, wherein the oil-in-water emulsion contains 10 to 70% by weight of one or more oil components, based on the weight of the oil-in-water emulsion.

* * * * *